United States Patent [19]

Bautze

[11] 4,388,130

[45] Jun. 14, 1983

[54] METHOD OF PRODUCING A PACKAGE FOR DISPLAY AND HANDLING OF FOIL ART

[76] Inventor: F. Jeffery Bautze, 136 Lakeshore Dr., Marlboro, Mass. 01752

[21] Appl. No.: 326,768

[22] Filed: Dec. 2, 1981

Related U.S. Application Data

[62] Division of Ser. No. 174,497, Aug. 1, 1980, abandoned.

[51] Int. Cl.[3] ..... B29C 27/20

[52] U.S. Cl. ..... 156/85; 40/158 R; 40/159; 206/45.33

[58] Field of Search ..... 156/84, 85; 40/158 A, 40/594, 595, 615, 159; 206/45.33, 45.31

[56] References Cited

U.S. PATENT DOCUMENTS

| | | | |
|---|---|---|---|
| 1,885,345 | 11/1932 | Guthrie | 156/84 |
| 2,014,414 | 9/1935 | Schneeweis | 40/620 |
| 2,557,402 | 6/1951 | Altheimer | 40/615 |
| 3,103,774 | 9/1963 | Wall | 206/497 |
| 3,582,439 | 6/1971 | Thomas | 156/277 |
| 3,677,399 | 7/1972 | Tatar | 206/497 |
| 3,738,903 | 6/1973 | Berwick et al. | 206/497 |
| 3,874,966 | 4/1975 | Garcia | 156/85 |
| 4,145,829 | 3/1979 | Peltier | 40/158 R |
| 4,170,836 | 10/1979 | Seufert | 40/158 R |
| 4,184,278 | 1/1980 | Fournet | 40/158 R |

*Primary Examiner*—Caleb Weston
*Attorney, Agent, or Firm*—William Nitkin

[57] ABSTRACT

A new and different package and method for making same for the display and handling of delicate foil art, such package having members including a backboard upon which foil art is affixed, a front mat placed thereover, a stiff plastic film disposed on top of the mat covering the foil art, and a shrink wrapping applied around the above.

1 Claim, 2 Drawing Figures

METHOD OF PRODUCING A PACKAGE FOR DISPLAY AND HANDLING OF FOIL ART

This application is a divisional application of my previously filed application under the same title Ser. No. 174,497 filed Aug. 1, 1980, abandoned.

BACKGROUND OF THE INVENTION

1. Field of the Invention

The structure and method of this invention relate to the packaging of printed pictorial material and more particularly to a double layer transparent protective packaging for foil art.

2. Description of the Prior Art

The packaging of foil art (or lithographic print engraved on foil) has long been a problem because such prints are quite delicate. They are usually prepared by first making lithographic plates, and special inks and waxes are layered upon a metallic sheeting. Then the print is engraved with microscopic lines which in effect capture and reflect available light creating special effects which appear to change the tonal quality of the view depending upon the angle of viewing and upon the lighting changes within the area in which the print is viewed. Such prints are called in the trade "foil art". Foil art is extremely delicate due to the nature of its structure and can easily be damaged by pressure thereon. Anything that scratches against the surface of the print will destroy the layers and cause the print to appear defective. Shrinkwrapping has been resorted to in order to protect such foil art, but it has been found that due to the flexible nature of the shrinkwrapping the surface of the foil art is still easily damaged both in transport to the point of sale and by the ultimate user when preparing the foil art for display.

SUMMARY OF THE INVENTION

It is therefore an object of this invention to provide an improved display packaging structure for foil art which is attractive, allows the print to be easily viewed, and yet protects the foil art from damage in handling.

It is a further object of this invention to disclose an improved method for the packaging of foil art.

Although foil art has been commercially available for sale for over twenty years, extensive retail commercial sales have been impossible due to the heavy incidence of damage to the surface of the prints. Foil art is sold almost exclusively at fairs, etc., by individual vendors watching closely over the product to prevent damage. By utilizing the packaging and method of the instant invention, it is expected that the commercialization of foil art will increase significantly as the foil art can now be safely transported and viewed within the same packaging.

As has been discussed above in the prior art, many people have applied shrinkwrapping around the foil views in hopes of protecting them, but such shrinkwrapping presents serious problems. Firstly, it can be easily dented inwards causing subsequent damage to the surface of the print. Secondly, the shrinkwrapping will often continue to shrink due to environmental conditions such as heat within the store in which it might be placed for sale causing the print to bow.

In the process of the instant invention disclosed herein, the foil art is first mounted by gluing upon a backboard having a thickness of at least 14 ply or equivalent process board. A front mat which may cover the outside edges of the foil art is then applied over the print and glued to the backboard. At this point a stiff plastic polyester film having a thickness of at least 10 mils of a size approximating the size of the front mat is placed thereover. Then the resulting sandwich is shrinkwrapped in a manner as will be described below. The process of utilizing the stiff film between the shrinkwrapping and the matted picture prevents the surface of the foil art from being damaged in transit to commercial establishments and protects the print in normal handling by store personnel where it is placed for sale, by customers selecting prints, and by ultimate purchasers.

DESCRIPTION OF THE PREFERRED EMBODIMENT(S)

Figure 1:
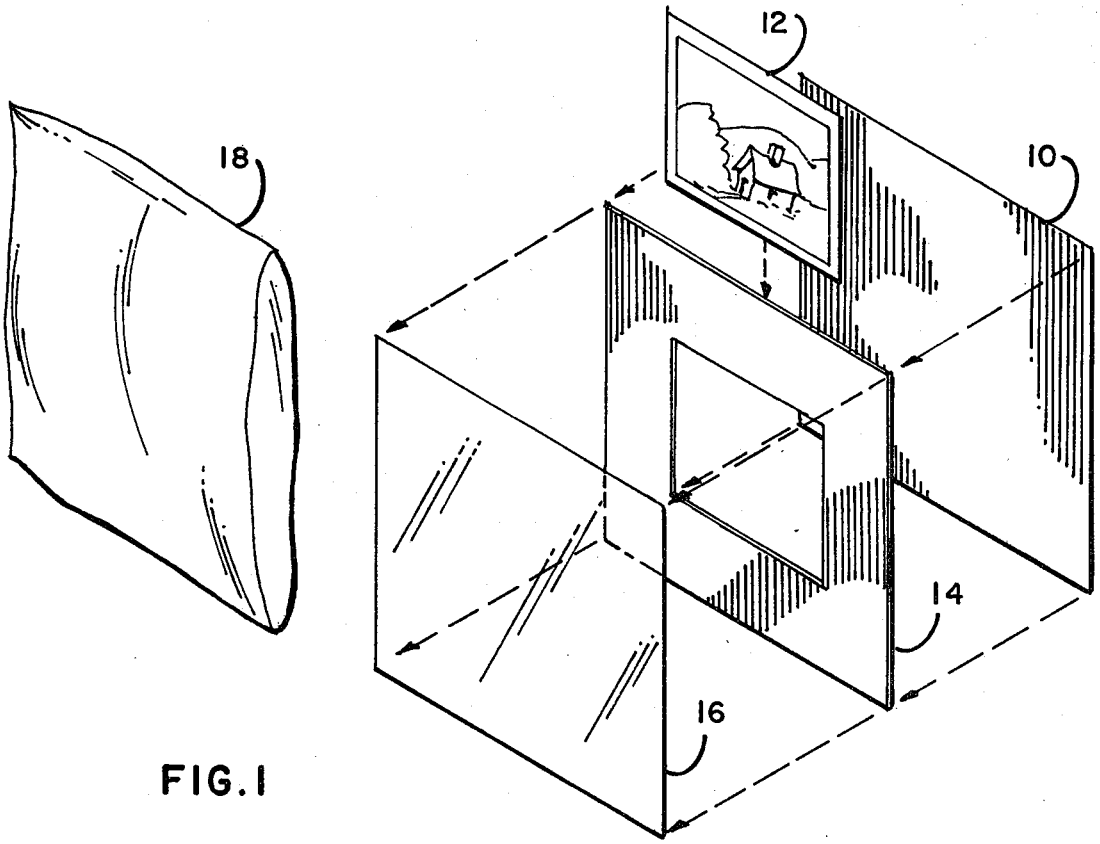
FIG. 1 illustrates the packaging of this invention in separated fashion from the foil art.
Figure 2:
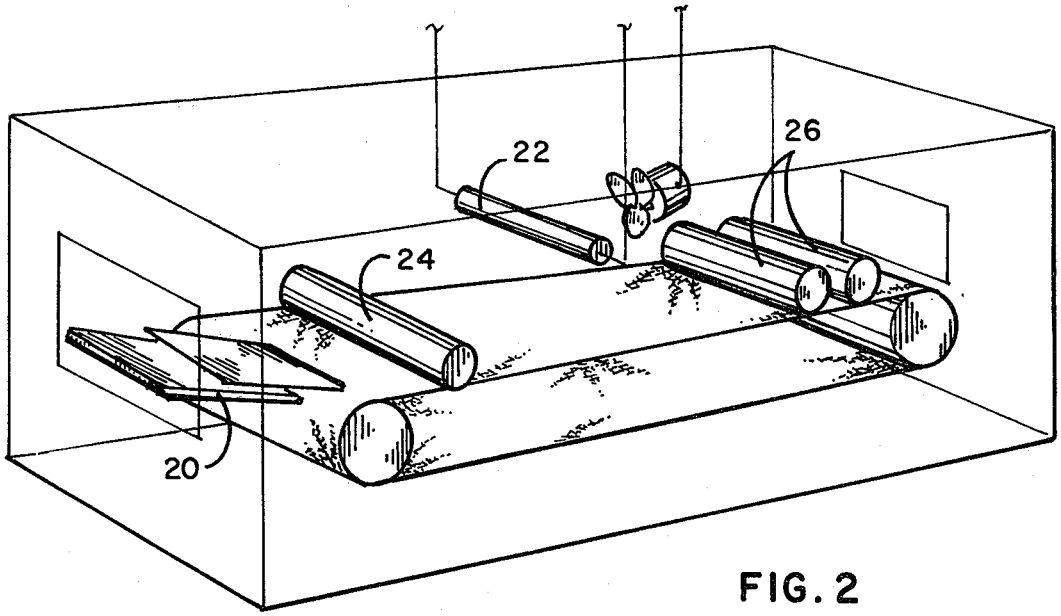
FIG. 2 illustrates the steps and the method of constructing the packaging of this invention.

FIG. 1 illustrates the components of the packaging of this invention. Seen in this view is backboard 10 upon which foil art 12 is adhered. Over the foil art and, if desired, covering the edges thereof, is front mat 14 which is adhered to backboard 10. The top surface of the mat is in a plane above that of the plane of the surface of the foil art. Above this front mat is placed a stiff plastic film 16 which, in the preferred embodiment, is a polyester film of at least 10 mils in thickness. An example of such film is sold by Transalwrap and is imported from France. Then the entire method print with plastic film 16 thereon is covered with a shrinkwrap 18 such as Clysar Film by Dupont which is a 75 gauge EHC (extra high clarity) folded oil-based film. I have found from experience that certain types of stiff plastic films and certain types of shrinkwraps are incompatible, for example, a cottonseed-based stiff plastic film may cause a chemical reaction with an oil-based shrinkwrap resulting in ink migration and/or visible oil spots. It has been found in use that one should not utilize polyvinylchloride which hinders the visibility of the foil art and which has a tendency to attract dust. After sandwiching the stiff plastic film and loosely covering the sandwich with the shrinkwrap and sealing the edges, one places the package upside down on a ledge 20 of the shrinkwrap heat tunnel seen in FIG. 2 for about 10 seconds so that the shrinkwrap shrinks slowly and this procedure helps to add smoothness to the final product and avoids tension at the edges which results in the formation of wrinkles. One then passes the product package under a first hot steel roller 24 to remove any remaining air. The shrinkwrap is then passed by a conveyor belt under a heat source 22 and passes below a second roller 26 which may be a double roller which irons out any remaining wrinkles. The structure of the packaging of this invention prevents burning of the foil art which often occurred using prior art techniques. It has been found that a package of this type has sufficient body within the plastic film, front mat and backboard to prevent bowing by any further shrinkage of the wrap. Further the covering is clear, and because of the stiff plastic film, one cannot easily damage the delicate foil art which is held somewhat beneath the surface of the film by the height of the front mat 14. In many instances the front may may be a of a foil-covered material. However, in some situations such as with very large foil art pictures, the front mat may be omitted from the package.

Although the present invention has been described with reference to particular embodiments, it will be apparent to those skilled in the art that variations and modifications can be substituted therefor without departing from the principles and spirit of the invention.

I claim:

1. The method of producing an improved package for the display and handling of foil art comprising the steps of:

determining the size of said foil art;

providing a backboard longer and wider than the size of said foil art said backboard having a thickness of at least 14 ply;

positioning said foil art and said backboard, leaving margins around all the sides of said foil art;

adhering said foil art to said backboard by adhesive;

providing a mat of the same size as said backboard, said mat having an aperture centrally defined therein slightly smaller than the size of said foil art;

positioning said mat over said backboard so that said aperture is above said foil art with a portion of said mat covering the edges of said foil art;

adhering said mat to said backboard;

providing a stiff plastic film of at least 10 mils in thickness of the approximate size of said backboard;

positioning said plastic film to contact said mat above said foil art;

putting said resulting backboard, foil art, mat, and stiff plastic film sandwich provided above into an approximately 75 gauge shrinkwrap envelope of clear chemically-compatible material; to said stiff plastic film;

sealing the edges of said shrinkwrap;

positioning the resulting shrinkwrap covered package on a ledge in a heat tunnel;

heating lightly said shrinkwrap causing slow shrinkage of said wrap;

rolling said sandwich package under a first hot roller to remove the air from therein;

heating said shrinkwrapping to cause said shrinkwrapping to shrink tightly around said sandwich package; and rolling said sandwich package under a second hot roller to iron any wrinkles remaining in said shrinkwrap.

providing a mat of the same size as said backboard having an aperture defined therein of the approximate size of said foil art;

adhering said mat to said backboard so that said aperture is above said foil art; and positioning said plastic film to contact said mat above said foil art.

* * * * *

UNITED STATES PATENT AND TRADEMARK OFFICE

CERTIFICATE OF CORRECTION

PATENT NO. : 4,388,130
DATED : June 14, 1983
INVENTOR(S) : F. Jeffery Bautze

It is certified that error appears in the above-identified patent and that said Letters Patent are hereby corrected as shown below:

Please delete from the first claim in column 4, lines 21 - 27 the following:

"providing a mat of the same size as said backboard having an aperture defined therein of the approximate size of said foil art;
adhering said mat to said backboard so that said aperture is above said foil art; and
positioning said plastic film to contact said mat above said foil art."

Signed and Sealed this

Sixth Day of September 1983

[SEAL]

*Attest:*

GERALD J. MOSSINGHOFF

*Attesting Officer*

*Commissioner of Patents and Trademarks*